US011014781B2

(12) United States Patent
Herkel et al.

(10) Patent No.: US 11,014,781 B2
(45) Date of Patent: May 25, 2021

(54) ELEVATOR SAFETY SYSTEM AND METHOD OF MONITORING AN ELEVATOR SYSTEM

(71) Applicant: Otis Elevator Company, Farmington, CT (US)

(72) Inventors: Peter Herkel, Berlin (DE); Dirk H. Tegtmeier, Berlin (DE)

(73) Assignee: OTIS ELEVATOR COMPANY, Farmington, CT (US)

( * ) Notice: Subject to any disclaimer, the term of this patent is extended or adjusted under 35 U.S.C. 154(b) by 542 days.

(21) Appl. No.: 15/901,028

(22) Filed: Feb. 21, 2018

(65) Prior Publication Data

US 2018/0237261 A1 Aug. 23, 2018

(30) Foreign Application Priority Data

Feb. 22, 2017 (EP) ..... 17157411

(51) Int. Cl.
*B66B 5/00* (2006.01)
*B66B 1/34* (2006.01)
(Continued)

(52) U.S. Cl.
CPC ..... *B66B 5/0031* (2013.01); *B66B 1/28* (2013.01); *B66B 1/3407* (2013.01);
(Continued)

(58) Field of Classification Search
CPC ... B66B 5/0031; B66B 1/3492; B66B 5/0018; B66B 5/02; B66B 13/24; B66B 13/00; B66B 5/0093; B66B 5/00
See application file for complete search history.

(56) References Cited

U.S. PATENT DOCUMENTS 4,658,935 A 4/1987 Holland
4,750,591 A * 6/1988 Coste ..... B66B 5/0006 187/391
(Continued)

FOREIGN PATENT DOCUMENTS

EP 2583928 A1 4/2013
JP 2006256795 A 9/2006
WO 2009081476 A1 7/2009

OTHER PUBLICATIONS

European Search Report for application EP 17157411.4, dated Jun. 14, 2017, 8 pages.

*Primary Examiner* — Marlon T Fletcher
(74) *Attorney, Agent, or Firm* — Cantor Colburn LLP

(57) ABSTRACT

An elevator safety system comprises: at least one position sensor, which is configured for determining a position value representing the position of the elevator car within the hoistway; at least one door sensor, which is configured for detecting whether the at least one door is closed; a limit setting unit, which is configured for determining an operation status of the elevator car and for setting at least one position limit according to the determined operation status; and a comparison unit, which is configured for comparing the determined position value with the set position limit and for determining an error condition, if the position value is not in compliance with the at least one position limit and the at least one door sensor indicates that at least one door is not closed.

13 Claims, 2 Drawing Sheets

(51) Int. Cl.

| | |
|---|---|
| ***B66B 3/00*** | (2006.01) |
| ***B66B 1/28*** | (2006.01) |
| ***B66B 1/40*** | (2006.01) |
| ***B66B 5/02*** | (2006.01) |
| ***B66B 9/00*** | (2006.01) |
| ***B66B 13/24*** | (2006.01) |

(52) U.S. Cl.

CPC ..... *B66B 1/3492* (2013.01); *B66B 1/40* (2013.01); *B66B 3/002* (2013.01); *B66B 5/02* (2013.01); *B66B 5/027* (2013.01); *B66B 9/00* (2013.01); *B66B 13/24* (2013.01); *B66B 1/285* (2013.01)

(56) References Cited

U.S. PATENT DOCUMENTS

| | | | | |
|---|---|---|---|---|
| 5,648,645 | A | 7/1997 | Arpagaus et al. | |
| 5,889,239 | A | 3/1999 | Blackaby et al. | |
| 5,896,950 | A | 4/1999 | Koh | |
| 5,955,708 | A | 9/1999 | Amano et al. | |
| 6,026,935 | A | 2/2000 | Koh | |
| 6,435,315 | B1 | 8/2002 | Zaharia | |
| 6,526,368 | B1 | 2/2003 | Coste et al. | |
| 6,700,347 | B1 | 3/2004 | Sakurai et al. | |
| 7,353,914 | B2 | 4/2008 | Deplazes | |
| 7,537,092 | B2 | 5/2009 | Birrer et al. | |
| 7,562,747 | B2 | 7/2009 | Marchesi | |
| 7,597,176 | B2 | 10/2009 | Zaharia | |
| 7,849,975 | B2 | 12/2010 | Ketonen et al. | |
| 8,123,003 | B2 | 2/2012 | Meri et al. | |
| 8,408,364 | B2 | 4/2013 | Kangas | |
| 8,863,908 | B2 | 10/2014 | Villa et al. | |
| 9,296,591 | B2 | 3/2016 | Garfinkel et al. | |
| 9,469,501 | B2 | 10/2016 | Lee | |
| 2004/0173413 | A1 | 9/2004 | Angst et al. | |
| 2009/0255762 | A1* | 10/2009 | Ketonen | B66B 13/22 187/247 |
| 2009/0277724 | A1 | 11/2009 | Thumm et al. | |
| 2009/0321192 | A1* | 12/2009 | Kattainen | B66B 13/22 187/279 |
| 2011/0162913 | A1* | 7/2011 | Kattainen | B66B 1/32 187/280 |
| 2011/0272218 | A1* | 11/2011 | Sonnenmoser | B66B 13/22 187/316 |
| 2012/0073909 | A1* | 3/2012 | Kondo | B66B 1/32 187/247 |
| 2012/0080273 | A1* | 4/2012 | Herkel | B66B 1/34 187/247 |
| 2012/0168262 | A1* | 7/2012 | Finschi | B66B 1/467 187/392 |
| 2015/0217968 | A1 | 8/2015 | Huff et al. | |
| 2015/0336768 | A1* | 11/2015 | Otsuka | B66B 1/36 187/394 |

* cited by examiner

ELEVATOR SAFETY SYSTEM AND METHOD OF MONITORING AN ELEVATOR SYSTEM

The present invention relates to an elevator safety system and to a method of monitoring an elevator system.

Elevator systems usually comprise an elevator safety system which is configured for monitoring and checking the operation of the elevator system in order to stop any further operation of the elevator system, in particular any movement of the elevator car, in case an unsafe condition of the elevator system occurs.

Elevator safety systems in particular are configured to ensure that all doors, in particular landing doors and door(s) of the elevator car, are closed unless the elevator car is stopped at a landing.

Such strict safety requirements, however, restrict the options of operation of the elevator system. This might result in a less efficient operation of the elevator system.

It therefore would be beneficial to provide an improved elevator safety system, in particular an elevator safety system which allows for a more flexible operation of the elevator system.

According to an embodiment of the invention an elevator safety system for an elevator system with at least one door and with an elevator car, which is movable along a hoistway between a plurality of landings, comprises: at least one position sensor, which is configured for determining a position value representing the position of the elevator car within the hoistway; at least one door sensor, which is configured for detecting whether the at least one door is closed; a limit setting unit, which is configured for determining an operation status of the elevator car and for setting at least one position limit according to the determined operation status; and a comparison unit, which is configured for comparing the determined position value with the set position limit and for determining an error condition, if the position value is not in compliance with the at least one position limit and the at least one door sensor indicates that at least one door is not closed.

According to an embodiment of the invention, a method of monitoring an elevator system with at least one door and with an elevator car, which is movable along a hoistway between a plurality of landings, comprises: determining the operation status of the elevator car and setting at least one position limit according to the operation status of the elevator car; determining whether all doors are closed; determining a position value representing the position of the elevator car within the hoistway; and comparing the determined position value with the position limit and determining an error condition of the elevator system if it is determined that the position value is not in compliance with the at least one position limit and that at least one door is not closed.

Exemplary embodiments of the invention further include an elevator system comprising at least one door, an elevator car, which is movable along a hoistway, and an elevator safety system according to an exemplary embodiment of the invention.

Exemplary embodiments of the invention allow to adjust the setting of the at least one position limit according to the current operation status of the elevator car. They in particular allow to optimize the regions (door zones) in which the doors of the elevator system may be opened for each operation status of the elevator system. As a result, the elevator system may be operated more efficiently without deteriorating the operational safety of the elevator system.

Exemplary embodiments of the invention will be described in the following with respect to the enclosed figures.

FIG. 1 illustrates a schematic view of an elevator system 2 with an elevator safety system according to an exemplary embodiment of the invention.

Figure 1:
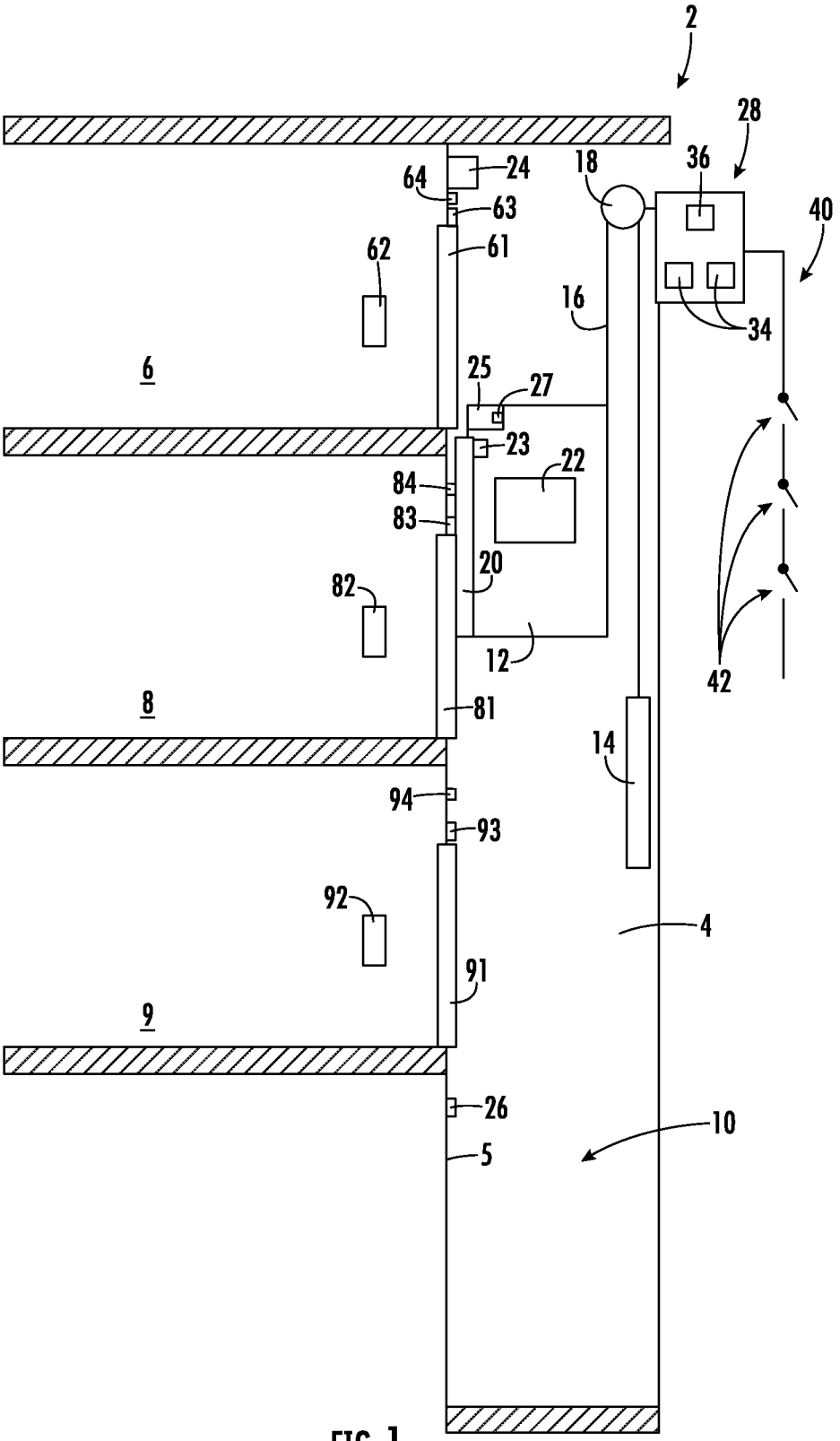
FIG. 1 shows a schematic view of an elevator system according to an exemplary embodiment of the invention.

The elevator system 2 comprises a hoistway 4 vertically extending between a plurality of floors/landings 6, 8, 9.

A landing door 61, 81, 91 providing access to the hoistway 4 and a control panel 62, 82, 92 are arranged at each of the landings 6, 8, 9, respectively.

An elevator car 12 and a corresponding counterweight 14 are movably suspended within the hoistway 4 by means of a tension member 16 allowing the elevator car 12 and the counterweight 14 to move vertically along the hoistway 4 in opposite directions.

The elevator car 12 is provided with at least one elevator car door 20 and an elevator car control panel 22.

The tension member 16 may be a rope, a belt or a combination of ropes/belts. The tension member 16 extends over a drive sheave 18, which is provided in an upper area of the hoistway 4.

FIG. 1 depicts a simple 1:1 suspension of the elevator car 12. The skilled person, however, will easily understand that different suspensions, such as 2:1, 4:1, 8:1 etc. and similar suspensions, which may include, or may not include, a counterweight 14, may be used in elevator systems 2 according to exemplary embodiments of the invention, as well.

The drive sheave 18 is driven by a drive machine (not shown) comprising a motor, thus forming a traction drive. The motor driving the drive sheave 18 is controlled by an elevator control 28 based on input provided via the control panels 62, 82, 92, 22 according to the passengers' requests. Other drive machines than a traction drive are conceivable as well, e.g. linear drives or hydraulic drives.

The elevator car 12 is provided with a position sensor 25, which is configured for providing a position value indicating the current position of the elevator car 12 while moving along the hoistway 4. The position sensor 25 may include a speed sensor 27 and/or an acceleration sensor (not shown) in order to determine the current position of the elevator car 12 within the hoistway 4 by measuring the current speed and/or acceleration of the elevator car 12 and integrating the measured speed and/or acceleration over time. Alternatively or additionally, the position sensor 25 may interact with a wall 5 of the hoistway 4 and/or markers 24, 26, 64, 84, 94, which are provided at the wall 5 of the hoistway 4, in order to determine the current position of the elevator car 12 within the hoistway 4. The position sensor 25 in particular may (re-)calibrate the position value, which has been determined by integrating the speed and/or the acceleration of the elevator car 12 over time, every time the position sensor 25 passes one of the markers 24, 26, 64, 84, 94.

In the embodiment shown in FIG. 1, a marker 64, 84, 94 is positioned at each landing 6, 8, 9, in particular at the top of the respective landing door 61, 81, 91, respectively. Additional markers 24, 26 are arranged at the top of the hoistway 4 and within a pit 10, which is formed at the bottom of the hoistway 4, respectively.

The configuration illustrated in FIG. 1, however, is only exemplary. It in particular is not necessary to provide a marker 64, 84, 94 at every landing 6, 8, 9. Further, the markers 64, 84, 94 assigned to the landings 6, 8, 9 may be provided at a different position than the top of the respective landing door 61, 81, 91. In principle, it might be sufficient to provide a single marker 24, 26, 64, 84, 94 at a predefined position within the hoistway 4 in order to (re)calibrate the position information whenever the elevator car 12 passes said marker 24, 26, 64, 84, 94.

The position information provided by the position sensor 25 may be transmitted to the elevator control 28 by means of a cable (not shown) extending along the hoistway 4, or by means of wireless data transmission.

The elevator control 28 is configured for controlling the movement of the elevator car 12 along the hoistway 4 by driving the drive sheave 18 based on the position information provided by the position sensor 25.

The at least one elevator car door 20 and the landing doors 61, 81, 91 are respectively provided with a door sensor 23, 63, 83, 93, which is configured to detect whether the respective door 20, 61, 81, 91 is open or (properly) closed.

The position sensor 25 and the door sensors 23, 63, 83, 93 are components of an elevator safety system. The elevator safety system includes a safety chain 40 comprising a plurality of contactors 42, which are configured for monitoring safety relevant functions of the elevator system 2. The elevator safety system in particular is configured to stop any movement of the elevator car 16 if at least one of the contactors 42 of the safety chain 40 is opened.

The elevator safety system further includes a limit setting unit 32 and a comparison unit 34. The limit setting unit 32 and the comparison unit 34 may be integrated with the elevator control 28, as shown in FIG. 1. In an alternative embodiment, which is not shown in the figures, the limit setting unit 32 and the comparison unit 34 may be provided separately from the elevator control 28.

The limit setting unit 32 is configured for determining a current operation status of the elevator car 12 and for setting at least one position limit according to the determined operation status. The limit setting unit 32 may be further configured for setting a speed limit according to the determined operation status.

The comparison unit 34 is configured for comparing the position value, which has been determined by the position sensor 25, with the position limit set by the limit setting unit 32. The comparison unit 34 is configured for determining an error condition, if the determined position value is not in compliance with the at least one position limit and at least one of the door sensors 23, 63, 83, 93 indicates that at least one of the doors 20, 61, 81, 91 is not closed.

The comparison unit 34 may be further configured for comparing the speed value, which has been determined by the position sensor 25, with the speed limit set by the limit setting unit 32. The comparison unit 34 is configured for determining an error condition, if the determined speed value is not in compliance with the speed limit and at least one of the door sensors 23, 63, 83, 93 indicates that at least one of the doors 20, 61, 81, 91 is not closed.

The elevator safety system may further include a counter 36, which is configured to be incremented every time the comparison unit 34 determines an error condition. In other words, the counter 36 is configured for counting the events in which an error condition has been determined.

Figure 2:
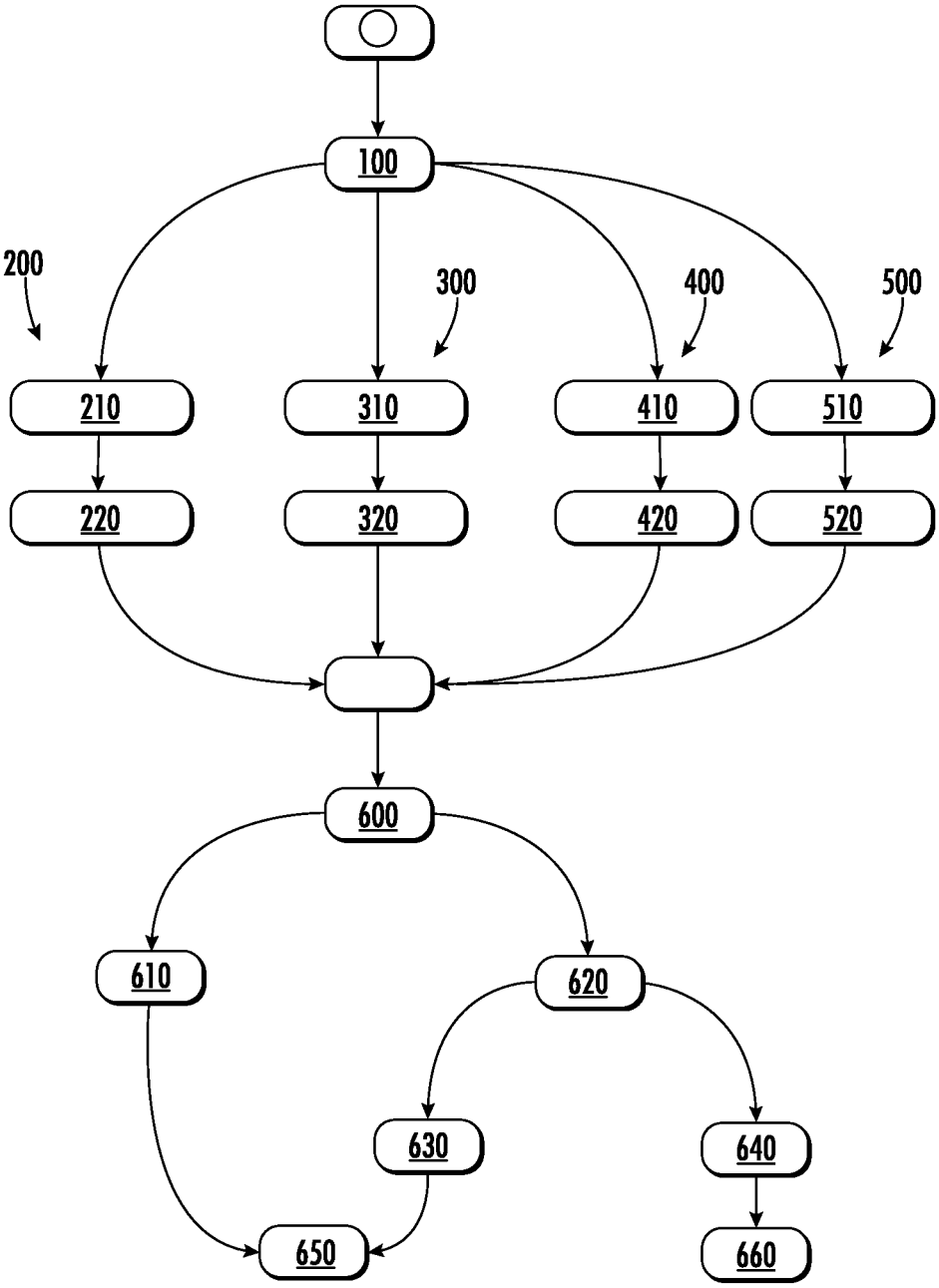
FIG. 2 is a flow chart illustrating the operation of an elevator safety system according to an exemplary embodiment of the invention.

FIG. 2 is a flow chart illustrating the operation of an elevator safety system 2 according to an exemplary embodiment of the invention.

In a first step 100, the current operation status of the elevator car 16 is determined. In the following steps limits for the position and the speed of the elevator car 16 are set according to said determined operation status.

The operation status of the elevator car 16 in particular may be a destination landing approaching operation 200, in which the elevator car 16 is approaching a destination landing 6, 8, 9 at which it is supposed to be stopped. In steps 210 and 220 a position limit and a speed limit corresponding to the destination landing approaching operation 200 are set, respectively.

The operation status of the elevator car 16 may also be a re-leveling operation 300. The re-leveling operation 300 is activated after the elevator car 16 has reached its destination landing 6, 8, and has been stopped at said destination landing 6, 8, 9. The re-leveling operation is configured to maintain the elevator car 16 at a constant height in level with the floor of the destination landing 6, 8, 9 even if the weight of the elevator car 16 changes due to a changing load, in particular passengers leaving from or entering into the elevator car 16. In steps 310 and 320 a position limit and a speed limit corresponding to the re-leveling operation 300 are set, respectively.

The operation status of the elevator car 16 further may be a landing departing operation 400. In the landing departing operation 400 the elevator car 16 is prepared for leaving the current landing 6, 8, 9 in order to allow for a quick start of the elevator 16. In steps 410 and 420 a position limit and a speed limit corresponding to the landing departing operation 400 are set, respectively.

The operation status of the elevator car 16 may be an inspection/maintenance operation 500 which is activated during inspection/maintenance of the elevator system 2 in order to allow for a more flexible operation of the elevator system 2. In steps 510 and 520 a position limit and a speed limit corresponding to the inspection/maintenance operation 500 are set, respectively.

In step 600 the current position and the current speed of the elevator car 16 are checked based on the position and speed values provided by the position sensor 25. The comparison unit 34 in particular compares the current position and speed values provided by the position sensor 25 with the respective limits which have been set before in steps 210, 220; 310, 320; 410, 420; or 510, 520 according to the actual status of the elevator car 16.

In case the current position and the current speed of the elevator car 16 are in compliance with the respective limits, i.e., in case the current position of the elevator car 16 is within a predetermined range and the current speed of the elevator car 16 is below a predetermined threshold, it is determined that the elevator system 2 is in a safe condition (step 610), the contactors 42 of the safety chain 40 are kept closed and normal operation of the elevator system 2 is continued (step 650).

In case, however, it is determined that at least one of the current position and the current speed of the elevator car 16 is not in compliance with the respective limits, i.e., the current position of the elevator car 16 is not within a predetermined range and/or the current speed of the elevator car 16 is above the predetermined threshold, it is checked in step 620 whether the elevator car door 20 and all landing doors 61, 81, 91 are closed.

In case all doors 20, 61, 81, 91 are closed, it is determined that the elevator system 2 is in a safe condition, the contactors 42 of the safety chain 40 are kept closed and normal operation of the elevator system 2 is continued (step 650).

However, if it is detected that at least one of the doors 20, 61, 81, 91 is not closed, while at least one of the current position and the current speed of the elevator car 16 are not in compliance with the respective limits, it is determined that the elevators system 2 is not in a safe condition but in an error condition (step 640).

In consequence, at least one contactor 42 of the safety chain 40 is opened (step 660). Interrupting the safety chain 40 stops any further movement of the elevator car 16. Additionally, an alarm message may be sent to a service center requesting a mechanic to visit the elevator system 2 in order to solve the problem and to resume a safe operation of the elevator system 2.

In an alternative embodiment, every time when it is determined that the elevator system 2 is not in a safe condition but in an error condition, the counter 36 is incremented. In such an embodiment, the safety chain 40 is interrupted only when the counter 36 exceeds a predetermined threshold. As a result, the operation of the elevator system 2 is not unnecessarily stopped if the position and/or time limits are exceeded accidentally only once.

In yet another embodiment, a message is sent to the service center requesting a mechanic to visit the elevator system 2 for solving the detected problem if the counter 36 exceeds a first threshold. However, the safety chain 40 is interrupted only when the counter 36 exceeds a second threshold, which is bigger than the first threshold.

During normal operation of the elevator system, the steps indicated in FIG. 2 are continuously repeated; i.e. after reaching step 650 the elevator safety system starts all over again with step 100 determining the current operation status of the elevator car 16.

A number of optional features are set out in the following. These features may be realized in particular embodiments, alone or in combination with any of the other features.

According to one embodiment, the elevator safety system, in particular the comparison unit, may be configured for issuing an alarm signal if an error condition is detected.

The alarm signal may be transmitted to a service center requesting a mechanic to visit the site in order to check the elevator system and to resume safe operation conditions. Additionally or alternatively, the alarm signal may cause to stop any further movement of the elevator car, e.g. by interrupting the safety chain of the elevator system, in order to prevent an unsafe operation of the elevator system.

According to one embodiment, the counter may be incremented every time it is determined that the elevator system is not in a safe condition but in an error condition. In such an embodiment, the safety chain is interrupted only when the counter exceeds a predetermined threshold. In consequence, operation of the elevator system is not unnecessarily stopped if the position and/or time limits are exceeded accidentally only once.

According to one embodiment, a message may be sent to the service center in order to request a mechanic to visit the elevator system for solving the detected problem if the counter exceeds a first threshold, but the safety chain is interrupted only when the counter exceeds a second threshold, which is bigger than the first threshold. This allows the operation of the elevator system to be continued if the limits are exceeded only occasionally. However, the elevator safety system causes a mechanic to visit the elevator system in order to check the elevator system and resume a safe operation of the elevator system.

According to one embodiment, the elevator safety system may further comprise at least one speed sensor, which is configured for determining a speed value representing the speed of the elevator car when moving within the hoistway. This allows the elevator system to monitor the operation of the elevator system not only based on the current position of the elevator car, but also based on the current speed of the elevator car. As a result, the safety of the elevator system is further enhanced, since the doors are not allowed to open if the elevator car moves at a speed, which is larger than a predetermined speed limit, even if the elevator car is located within a door zone.

The limit setting unit in particular may be configured for setting at least one speed limit for the speed of the elevator car within the hoistway according to the determined operation status of the elevator car, and the comparison unit may be configured for determining an error condition if the determined speed value exceeds the at least one set speed limit. As a result, the efficiency of the elevator system is further enhanced.

According to one embodiment, the limit setting unit is configured for setting an upper position limit and a lower position limit in order to define a door zone or range in which the door(s) are allowed to open if the elevator car is arranged in said door zone or range. The door zones or ranges in particular may be centered around the landings and/or around the landing doors in order to allow the door(s) to open as soon as the elevator car enters the respective door zone or range.

According to one embodiment, the operation status of the elevator car in particular may be a destination landing approaching operation, in which the elevator car is approaching a destination landing at which it is supposed to be stopped. A position limit and a speed limit corresponding to the destination landing approaching operation may be set, respectively.

The position limit and a speed limit set in the destination landing approaching operation in particular may allow to start opening selected doors of the elevator system, in particular the door(s) of the elevator car and/or the door(s) of the destination landing before the elevator car has reached its final position at the destination landing. This allows passengers to leave from and enter into the elevator car immediately as soon as the elevator car has reached its final position at the destination landing.

According to one embodiment, the operation status of the elevator car may be a re-leveling operation, which is activated after the elevator car has reached and has been stopped at a destination landing. The re-leveling operation may be configured to maintain the elevator car at a constant height next to the destination landing even if its weight changes due to passengers leaving from or entering into the elevator car.

The range of allowable positions, the difference between an upper and a lower position limit, and the speed limit corresponding to the re-leveling operation may be smaller than the range of allowable positions and the speed limit corresponding to the destination landing approaching operation, as the elevator car is not supposed to move at all during the re-leveling operation. Thus, the range of allowable positions and the speed limit corresponding to the re-leveling operation may be smaller than in the destination landing approaching operation without deteriorating the efficiency of the elevator system.

According to one embodiment, the operation status of the elevator car may be a landing departing operation in which the elevator car is prepared for leaving the current landing in order to allow for a quick start of the elevator. In order to enhance the efficiency of the elevator system, the range of allowable positions and the speed limit corresponding to the re-leveling operation may be larger than the range of allowable positions and the speed limit corresponding to the re-leveling operation.

According to one embodiment, the at least one position sensor may be configured for continuously determining the position value and/or the at least one speed sensor may be configured for continuously determining the speed value. Continuously monitoring the position value and/or the speed value of the elevator car enhances the safety of the elevator system even further.

According to one embodiment, the elevator safety system is configured to allow operating the elevator system in a rescue mode if an error condition is determined and/or after the safety chain has been interrupted. The rescue mode in particular may include moving the elevator car to the next or to a predetermined floor and to allow passengers to leave the elevator car. This prevents passengers from being trapped within the elevator car after an error condition has been detected and/or after the safety chain has been interrupted.

While the invention has been described with reference to exemplary embodiments, it will be understood by those skilled in the art that various changes may be made and equivalents may be substituted for elements thereof without departing from the scope of the invention. In addition many modifications may be made to adopt a particular situation or material to the teachings of the invention without departing from the essential scope thereof. Therefore, it is intended that the invention not be limited to the particular embodiment disclosed, but that the invention includes all embodiments falling within the scope of the claims.

REFERENCES

2 elevator system
4 hoistway
5 wall of the hoistway
6, 8, 9 floors/landings
10 pit
12 elevator car
14 counterweight
16 tension member
18 drive sheave
20 elevator car door
22 elevator car control panel
23 door sensor
24 marker
25 speed sensor
26 marker
27 speed sensor
38 elevator control
30 flow chart of a method of controlling the elevator safety system
32 limit setting unit
34 comparison unit
36 counter
61, 81, 91 landing door
63, 83, 93 door sensor
64, 84, 94 marker
100 determining the current operation status of the elevator car
200 landing approaching operation
210 setting a position limit for the landing approaching operation
220 setting a speed limit for the landing approaching operation
300 re-leveling operation
310 setting a position limit for the re-leveling operation
320 setting a speed limit for the re-leveling operation
400 landing departing operation
410 setting a position limit for the landing departing operation
420 setting a speed limit for the landing departing operation
500 inspection/maintenance operation
510 setting a position limit for the inspection/maintenance operation
520 setting a speed limit for the inspection/maintenance operation
610 determining that the elevator system is in a safe condition
620 checking whether all doors are closed
630 determining that the elevator system is in a safe condition
640 determining that the elevator system is in an error condition
650 continuing normal operation of the elevator system
660 opening the safety chain

What is claimed is:

1. An elevator safety system for an elevator system with at least one door and with an elevator car, which is movable along a hoistway between a plurality of landings, wherein the elevator safety system comprises:

at least one position sensor, which is configured for determining a position value representing the position of the elevator car within the hoistway;

at least one door sensor, which is configured for detecting whether the at least one door is closed;

a limit setting unit, which is configured for determining an operation status of the elevator car and for setting at least one position limit according to the determined operation status; and a comparison unit, which is configured for comparing the determined position value with the set position limit and for determining an error condition if the position value is not in compliance with the at least one position limit and the at least one door sensor indicates that at least one door is not closed;

wherein the operation status of the elevator car comprises a destination landing approaching operation in which the elevator car approaches a destination landing and re-leveling operation in which the elevator car has reached the destination landing and is stopping at the destination landing.

2. The elevator safety system according to claim 1, wherein the comparison unit is configured for issuing an alarm signal if an error condition is detected.

3. The elevator safety system according to claim 1, wherein the operation status of the elevator car further comprises a landing departing operation in which the elevator car is prepared for leaving one of the landings.

4. The elevator safety system according to claim 1, further comprising at least one speed sensor, which is configured for determining a speed value representing the speed of the elevator car when moving within the hoistway.

5. The elevator safety system according to claim 1, which is configured for interrupting a safety chain of the elevator system if an error condition is determined.

6. The elevator safety system according to claim 1, wherein the at least one position sensor is configured for continuously determining the position value and/or the at least one speed sensor is configured for continuously determining the speed value.

7. The elevator safety system according to claim 1, which is configured for allowing to operate the elevator system in a rescue mode if an error condition is determined and/or after the safety chain has been interrupted.

8. An elevator system comprising an elevator car, which is movable along a hoistway, and an elevator safety system according to claim 1.

9. An elevator safety system for an elevator system with at least one door and with an elevator car, which is movable along a hoistway between a plurality of landings, wherein the elevator safety system comprises:

at least one position sensor, which is configured for determining a position value representing the position of the elevator car within the hoistway;

at least one door sensor, which is configured for detecting whether the at least one door is closed;

a limit setting unit, which is configured for determining an operation status of the elevator car and for setting at least one position limit according to the determined operation status; and a comparison unit, which is configured for comparing the determined position value with the set position limit and for determining an error condition if the position value is not in compliance with the at least one position limit and the at least one door sensor indicates that at least one door is not closed;

wherein the limit setting unit is configured for setting an upper position limit and a lower position limit, wherein in particular the difference between the upper and lower position limits in the destination landing approaching operation is bigger than the difference between the upper and lower position limits in the re-leveling operation.

10. The elevator safety system according to claim 9, wherein the limit setting unit is further configured for setting at least one speed limit for the speed of the elevator car within the hoistway according to the determined operation status of the elevator car, and wherein the comparison unit is further configured for determining an error condition if the determined speed value exceeds the at least one set speed limit.

11. An elevator safety system for an elevator system with at least one door and with an elevator car, which is movable along a hoistway between a plurality of landings, wherein the elevator safety system comprises:

at least one position sensor, which is configured for determining a position value representing the position of the elevator car within the hoistway;

at least one door sensor, which is configured for detecting whether the at least one door is closed;

a limit setting unit, which is configured for determining an operation status of the elevator car and for setting at least one position limit according to the determined operation status;

a comparison unit, which is configured for comparing the determined position value with the set position limit and for determining an error condition if the position value is not in compliance with the at least one position limit and the at least one door sensor indicates that at least one door is not closed;

the elevator safety system configured for incrementing a counter every time an error condition is determined, and for interrupting the safety chain of the elevator system when the counter exceeds a predetermined threshold.

12. A method of monitoring an elevator system with at least one door and with an elevator car, which is movable along a hoistway between a plurality of landings, wherein the method comprises:

determining the operation status of the elevator car and setting at least one position limit according to the determined operation status of the elevator car;

determining whether all doors are closed;

determining a position value representing the position of the elevator car within the hoistway; and comparing the determined position value with the position limit and determining an error condition of the elevator system if it is determined that the position value is not in compliance with the at least one position limit and that at least one door is not closed;

wherein the operation status of the elevator car comprises a destination landing approaching operation in which the elevator car approaches a destination landing and re-leveling operation in which the elevator car has reached the destination landing and is stopping at the destination landing.

13. The method according to claim 12, wherein the operation status of the elevator car comprises a landing departing operation in which the elevator car is prepared for leaving one of the landings.

* * * * *